US012239171B1

(12) United States Patent
Barbosa, III et al.

(10) Patent No.: US 12,239,171 B1
(45) Date of Patent: Mar. 4, 2025

(54) LACTATION SHIELD

(71) Applicants: Louis Barbosa, III, Fenton, MO (US); Tamra J. Barbosa, Fenton, MO (US)

(72) Inventors: Louis Barbosa, III, Fenton, MO (US); Tamra J. Barbosa, Fenton, MO (US)

( * ) Notice: Subject to any disclaimer, the term of this patent is extended or adjusted under 35 U.S.C. 154(b) by 180 days.

(21) Appl. No.: 18/126,407

(22) Filed: Mar. 25, 2023

(51) Int. Cl.
*A47C 7/66* (2006.01)
*A41D 1/215* (2018.01)
*A47G 5/00* (2006.01)

(52) U.S. Cl.
CPC ..... *A41D 1/215* (2018.01); *A47C 7/66* (2013.01); *A47G 5/00* (2013.01)

(58) Field of Classification Search
CPC ..... A47C 7/66; A47C 7/666; A41D 1/215; A47G 5/00
USPC ..... 297/184.1, 184.11, 184.12, 184.13, 297/184.14, 184.15; 160/135, 351
See application file for complete search history.

(56) References Cited

U.S. PATENT DOCUMENTS 1,416,733 A * 5/1922 Matson ..... A47G 5/00 160/125
2,855,041 A * 10/1958 Blashfield ..... A47H 1/022 5/512
3,339,566 A * 9/1967 Bowden ..... B60N 2/286 297/184.11 X
3,845,985 A * 11/1974 Behrend ..... A47C 7/666 297/184.14
3,913,598 A * 10/1975 Glutting, Jr. ..... E04H 15/48 160/135 X
4,079,771 A * 3/1978 Theiss ..... A47H 1/102 160/90
4,139,101 A * 2/1979 Towfigh ..... A47G 5/00 160/351
4,384,371 A * 5/1983 Sonne ..... A42B 1/205 2/209.12
4,631,754 A * 12/1986 Ryan ..... A41D 1/215 2/104
4,651,349 A * 3/1987 Heiler ..... A41D 1/215 2/104
4,773,437 A * 9/1988 Glutting ..... E04H 15/001 160/135 X (Continued)

FOREIGN PATENT DOCUMENTS

CN 205728153 U * 11/2016
CN 106263127 B 10/2017

(Continued)

OTHER PUBLICATIONS

Translation of CN 209376742, Sep. 13, 2019.
Translation of CN 106263127, Oct. 24, 2017.

*Primary Examiner* — Rodney B White
(74) *Attorney, Agent, or Firm* — Grace J. Fishel

(57) ABSTRACT

A framework for supporting a piece of fabric forming a concealed space within which a mother may sit for infant lactation. The framework has side arms mounted on a horizontal cross member with fasteners that permit vertical movement and horizontal movement of the side arms with respect the horizontal cross member. The framework having elongated flat feet attached to vertical support members with fasteners that permit rotation of the flat feet on the vertical support members and movement of the vertical support members along the flat feet. Swivel fasteners are positioned along the side arms and horizontal cross member for attachment of the fabric.

8 Claims, 5 Drawing Sheets

(56) References Cited

U.S. PATENT DOCUMENTS 4,781,411 A * 11/1988 Kolb ..... B63B 17/02 297/184.15 X
4,797,953 A * 1/1989 Dameron ..... A41D 1/215 2/104
4,989,268 A * 2/1991 Stolhand ..... A41D 1/215 2/104
4,995,116 A * 2/1991 Beauchamp ..... A41D 1/215 2/104
5,034,999 A * 7/1991 Lubbers ..... A41D 1/215 2/104
5,038,411 A * 8/1991 St. Armand ..... A41D 1/215 2/104
5,090,059 A * 2/1992 Kahl ..... A41D 1/215 2/104
5,096,257 A * 3/1992 Clark ..... A47C 1/143 297/184.15 X
5,154,473 A * 10/1992 Joranco ..... A47C 7/66 297/184.15 X
5,479,662 A * 1/1996 Runco ..... A41D 1/215 2/48
5,544,364 A * 8/1996 Weber ..... A41D 1/215 2/48
5,579,797 A * 12/1996 Rogers ..... A45B 23/00 135/96
5,652,958 A * 8/1997 Farrell-Mestas ..... A41D 1/215 2/48
5,652,960 A * 8/1997 Kaknevicius ..... A41D 1/215 297/184.11 X
5,797,650 A * 8/1998 Gonzalez, Jr. ..... A47C 7/66 297/184.1 X
5,848,439 A * 12/1998 Huseth ..... A41D 1/215 2/48
6,112,748 A * 9/2000 Esdale ..... A47D 13/083 128/898
6,216,274 B1 * 4/2001 Harris ..... A41D 1/215 2/48
6,244,286 B1 * 6/2001 Russo ..... A47C 7/66 297/184.11 X
6,301,713 B1 * 10/2001 Aceves ..... A41D 1/215 2/104
6,823,883 B1 * 11/2004 Sears ..... E04H 15/003 248/99
7,114,191 B1 * 10/2006 Butler-Penenberg ..... A41D 1/215 2/104
7,207,070 B1 * 4/2007 Swarez-Ballesteros ..... A41D 1/215 2/104
7,302,957 B2 12/2007 Ross
7,374,238 B2 * 5/2008 Lingwall ..... A47C 15/004 297/184.11 X
7,406,718 B1 * 8/2008 Ekelund ..... A41D 27/06 2/104
7,445,280 B2 11/2008 Stoline-Litwin
7,765,613 B2 * 8/2010 Carr ..... A45F 3/02 2/104
8,151,372 B2 * 4/2012 Densmore ..... A41D 1/215 2/48
8,671,465 B2 * 3/2014 Armstrong ..... A41D 1/215 2/48
8,990,968 B2 * 3/2015 Garegnani ..... A41D 1/215 2/104
9,003,565 B1 * 4/2015 Leach ..... A41D 1/215 2/104
9,380,815 B2 * 7/2016 Toro-Gerstein ..... A41D 1/215
9,428,932 B2 8/2016 Daly
9,635,956 B1 * 5/2017 Leach ..... A47D 15/00
9,968,148 B2 * 5/2018 Gibbons ..... A41D 1/215
10,010,119 B2 * 7/2018 Butler ..... A41D 1/215
10,264,832 B2 * 4/2019 Gibbons ..... A41D 23/00
10,800,532 B2 10/2020 Hall, Jr. et al.
11,039,698 B2 6/2021 Fung-A-Wing
11,445,773 B2 * 9/2022 Gibbons ..... A41D 15/00
11,849,776 B1 * 12/2023 Samuelson ..... A41D 1/215
12,096,808 B2 * 9/2024 Samuelson ..... F04D 25/084
2005/0077015 A1 * 4/2005 Melino ..... E04G 21/243 160/135
2008/0276371 A1 * 11/2008 Stowers ..... A47G 5/00 5/513
2009/0193561 A1 * 8/2009 Masukawa ..... A47D 15/00 2/104
2010/0253118 A1 * 10/2010 Gressette, III ..... A01M 31/02 297/354.1
2012/0042919 A1 2/2012 Bezotte Bennett
2012/0131723 A1 * 5/2012 Greenwood ..... A41D 1/215 2/104
2012/0151657 A1 * 6/2012 Gibbons ..... A41D 1/215 2/104
2014/0007315 A1 * 1/2014 Toro-Gerstein ..... A41D 1/215 2/104
2015/0196126 A1 * 7/2015 Bowe ..... B62B 9/142 297/184.13 X
2017/0258234 A1 9/2017 Smith
2018/0228301 A1 * 8/2018 Winfield Kmiec .... A41D 11/00
2022/0136240 A1 * 5/2022 Sollie ..... A47G 5/00 160/135
2023/0070263 A1 * 3/2023 Gibbons ..... A41D 1/215

FOREIGN PATENT DOCUMENTS

CN 209376742 U 9/2019
FR 2675363 A1 * 10/1992 ..... A47G 5/00
WO WO-2018111070 A1 * 6/2018 ..... A47C 7/66

* cited by examiner

LACTATION SHIELD

BACKGROUND OF THE INVENTION

Field of the Invention

The present invention relates to a framework for supporting a piece of fabric forming a concealed open space for infant lactation within which a mother may position her body while seated in a seat or chair.

Brief Description of the Prior Art

Many privacy devices for nursing a baby are designed to attach to the mother and drape a piece of fabric over the baby. This makes it difficult to discretely position the infant such that it may latch. The cover also blocks air flow and is hot and uncomfortable to both the mother and the infant. In addition the cover blocks eye contact.

Breastfeeding is on the rise and mothers need something better that will allow them to nurse comfortably without exposure, frustration and embarrassment.

BRIEF SUMMARY OF VARIOUS PREFERRED EMBODIMENTS OF THE INVENTION

This section provides a general summary of the disclosure, and is not a comprehensive disclosure of its full scope or all of its features.

In accordance with the various embodiments of the present invention, a framework for supporting a piece of fabric forming a concealed space for infant lactation within which a mother may position her body while seated in a seat or chair is disclosed. The support frame includes the following elements:

- a horizontal cross member formed of telescoping sections mounted on first and second vertical support members formed of telescoping sections,
- first and second side arms formed of telescoping sections mounted at opposite ends of the horizontal cross member with mechanical fasteners that allow angular movement of the first and second side arms in two planes with respect to the horizontal cross member,
- first and second elongated flat feet attached to the first and second vertical support members opposite the horizontal cross member with mechanical fasteners that allow rotation of the first and second feet on the first and second vertical support members and longitudinal movement along the first and second feet respectively,
- at least one pivotable fastener attached to each of said horizontal cross member and first and second side arms for attachment of the piece of fabric.

In some embodiments a snap or twist lock is provided on the horizontal cross member for controlling the extent to which the telescoping sections extend. In other embodiments a snap or twist lock is provided on each of the vertical support members and side arms for controlling the extent to which the telescoping sections extend.

In another aspect the side arms are mounted at opposite ends of the horizontal cross member with a spring loop with tabs around the horizontal cross member and with a tongue formed on an end of the side arm positioned between the tabs. A bolt passes through apertures in the tabs and the tongue and a nut when tightened on the bolt causes the spring loop to tighten on the horizontal cross member allowing a vertical angle of the side arm with respect to the horizontal cross member to be adjusted and set. As the nut is tightened on the bolt the tongue is pinched between the tabs allowing a horizontal angle of each side arm to the horizontal cross member to be adjusted and set also.

In other applications elongated flat feet have a side slide with an elongated slot and a spring loop with tabs is mounted around the vertical support members. A bolt passes through the elongated slot and through apertures in the tabs to tighten the tabs against the slide to set the angle elongated feet make with respect to the horizontal cross member and set longitudinal movement of the vertical support members along the feet.

BRIEF DESCRIPTION OF THE SEVERAL VIEWS OF THE DRAWINGS

In the accompanying drawings in which one of various possible embodiments of the invention is illustrated, corresponding reference characters refer to corresponding parts throughout the several views of the drawings in which.

DETAILED DESCRIPTION OF AT LEAST ONE PREFERRED EMBODIMENT OF THE INVENTION

Figure 1:
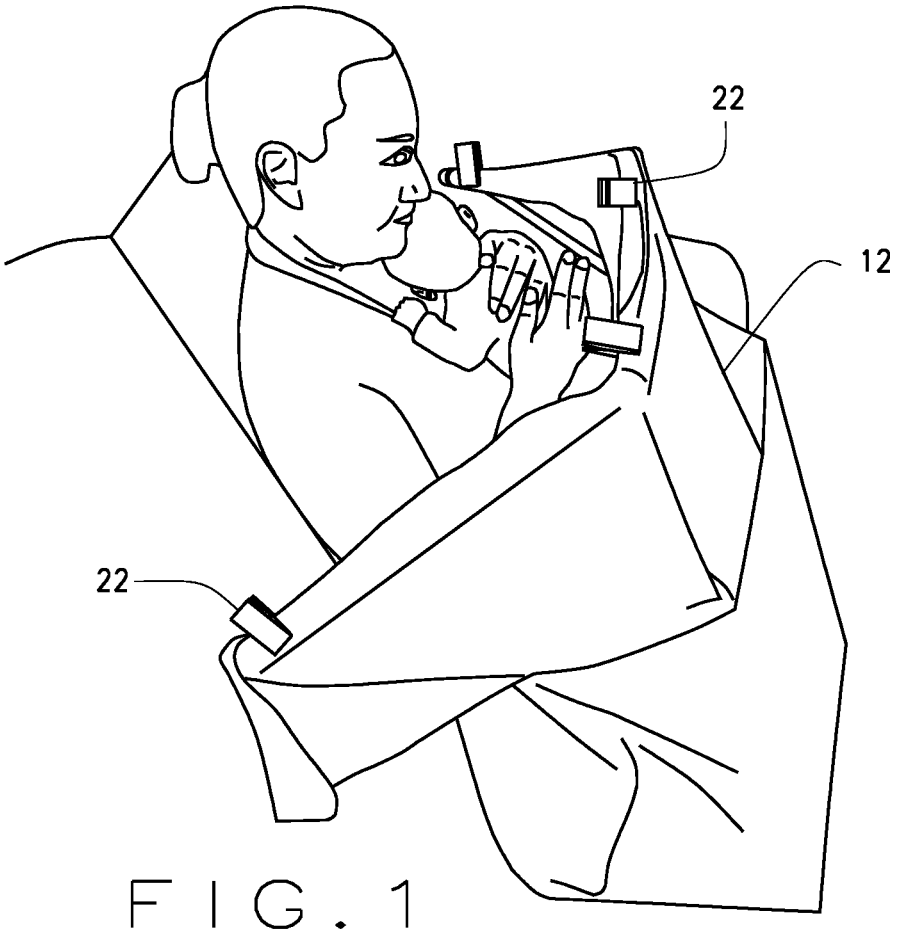
FIG. 1 is a perspective view of a framework in accordance with the present invention in use.
Figure 2:
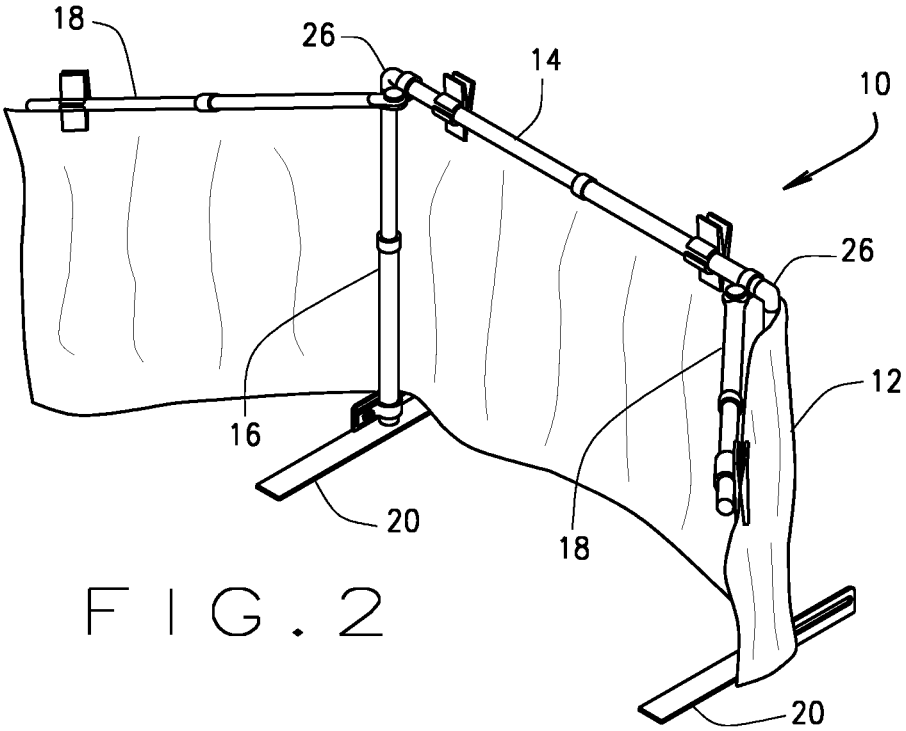
FIG. 2 is a perspective of the framework with a piece of material attached around the periphery with swivel fasteners.
Figure 3:
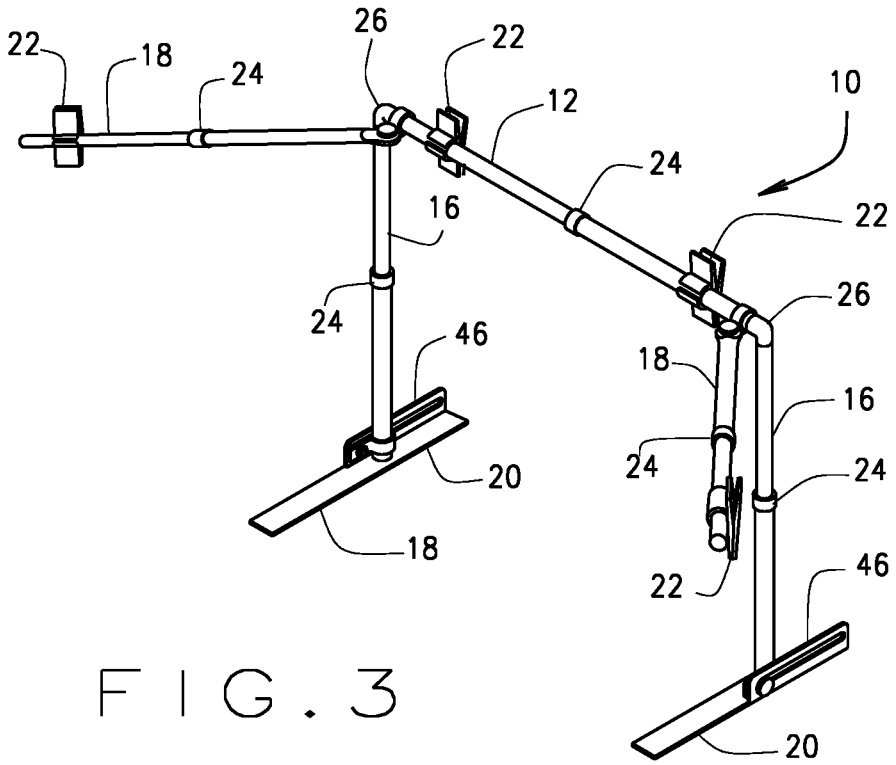
FIG. 3 is a perspective of the framework with the piece of material removed for clarity.
Figure 4:
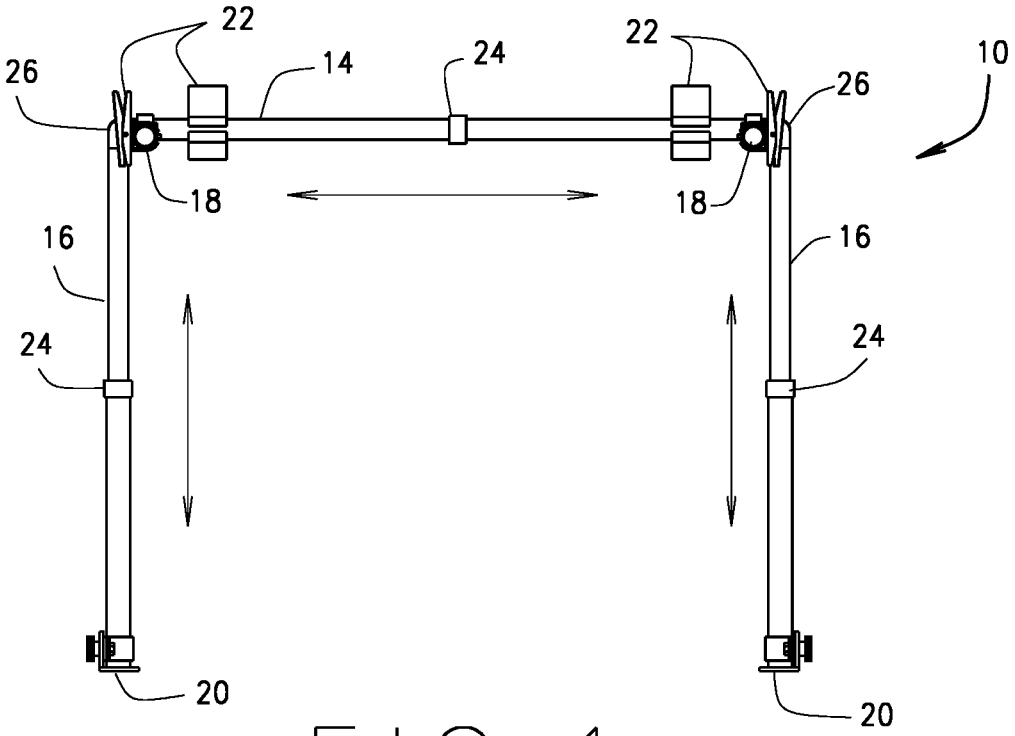
FIG. 4 is an inside view of the framework as viewed by a user.
Figure 5:
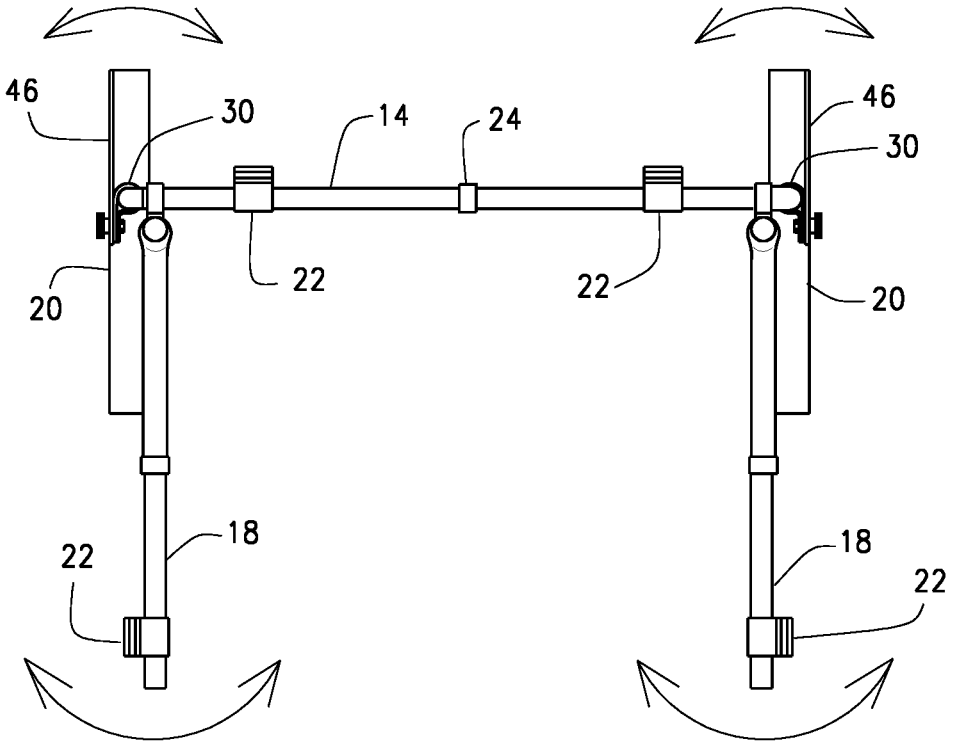
FIG. 5 is a top view of the of the framework.
Figure 6:
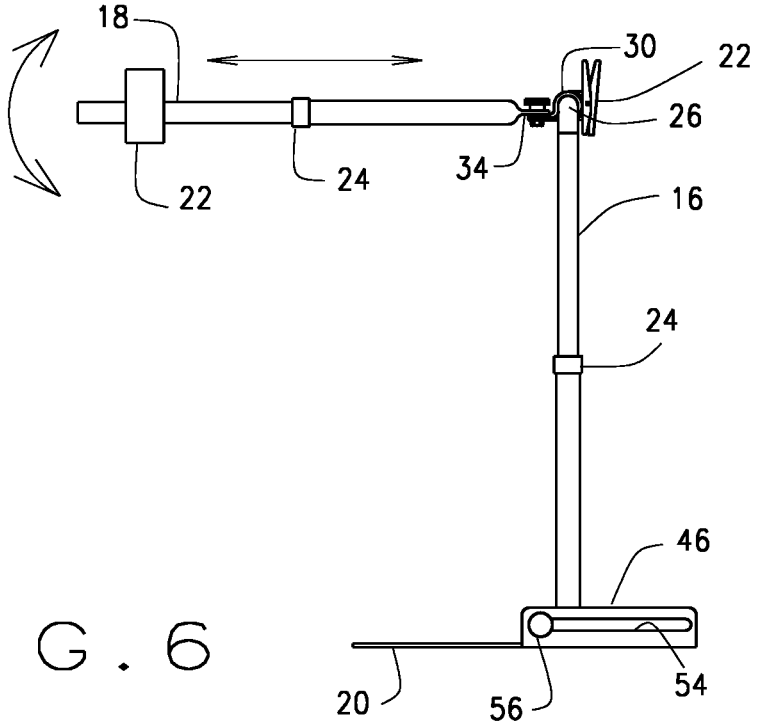
FIG. 6 is a side view of the framework.

Referring to the drawings more particularly by reference number a framework 10 for supporting a piece of fabric 12 to form a concealed space for infant lactation is shown. The piece of fabric 12 may be a decorative baby blanket or even a cherished hand made knitted blanket as soiling is avoided. As best seen in FIG. 3, framework 10 in major part includes a horizontal cross member 14, first and second vertical support members 16, first and second side arms 18 and first and second elongated flat feet 20, together with swivel fasteners 22 shown in FIGS. 1, 2, 9A and 9B for attachment of the piece of fabric 12.

Horizontal cross member 14, first and second vertical support members 16 and first and second side arms 18 are formed with telescoping sections, one portion of which slides inside the other with a snap pin or twist lock 24 to establish the extent to which the telescoping sections extend. Telescoping sections allow a user to adjust the width and height of framework 10 to fit the user and also allow framework 10 to compact in collapsed form as described below. In the illustrated embodiment, when fully extended or deployed, horizontal cross member 14 defines a space from about 12 to about 24 inches, first and second vertical support members 16 from about 9 to about 18 inches and side arms 18 from about 9 to about 18. As will be apparent based on the instant disclosure, the dimensions of the space defined by framework 10 may vary without departing from the spirit and scope of the disclosure.

Figure 7:
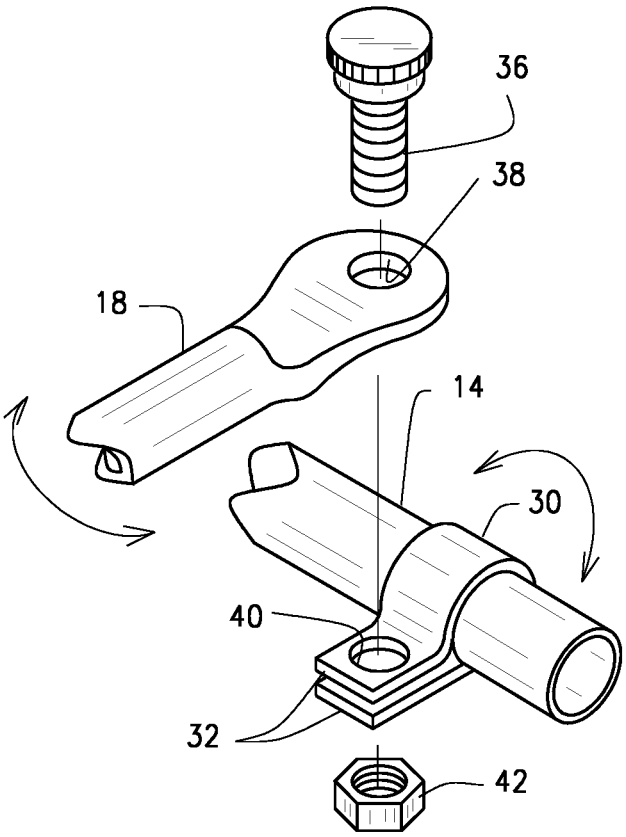
FIG. 7 is a perspective view of a fastener for angular movement of a side arm in two planes with respect to a horizontal cross member.

As shown in the drawings, horizontal cross member 14 is mounted on first and second vertical support members 16 with right angle elbows 26 such that first and second vertical support members 16 are at approximately right angles, or perpendicular to horizontal cross member 14. First and second side arms 18 are mounted at opposite ends of horizontal cross member 14 inboard of right angle elbows 26 with a first mechanical fastener 28 for angular movement of the side arms in two planes with respect to horizontal cross member 14. As shown in FIG. 7, each first mechanical fastener 28 comprises a spring loop 30 with end tabs 32 between which is received a tongue 34 provided on an end of each side arm 18. A bolt 36 is passed through an aperture 38 in tongue 34 and aligned apertures 40 in tabs 32. A nut 42 when tightened on bolt 36 causes spring loop 30 is tighten on horizontal cross member 14 allowing the vertical angle of each side arm 18 to horizontal cross member 14 to be adjusted and set. Upward movement of side arms 18 may be used to block the view of a person setting on the right or the left of the user. As nut 42 is tightened on bolt 36 and tongue 34 is pinched between tabs 32, the horizontal angle of each side arm 18 to horizontal cross member 14 may be adjusted and set, for example wider to accommodate a bigger person or narrower to fit within the dimensions of a chair with arms.

Figure 8:
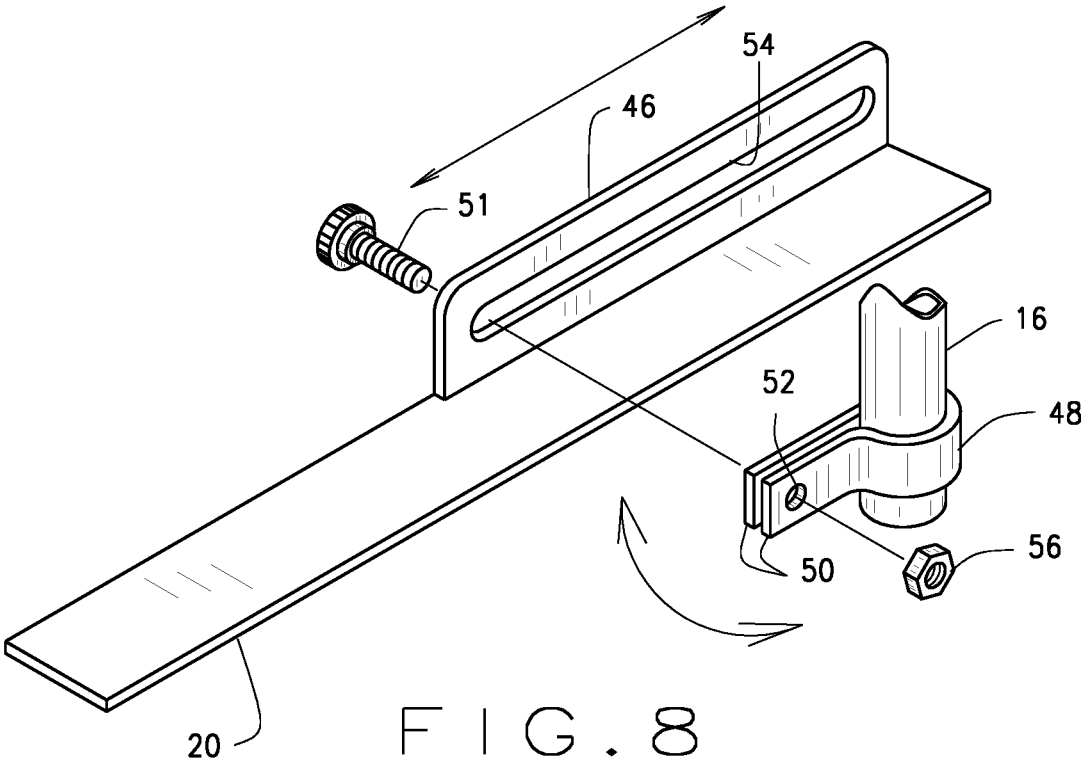
FIG. 8 is a perspective view of a fastener that permits rotation of elongated flat feet on vertical support members and which allow movement of the vertical support member along the elongated flat feet.

First and second elongated flat feet 20 are attached to first and second vertical support members 16 opposite horizontal cross member 14 with a second mechanical fastener 44 permitting rotation of the first and second elongated flat feet 20 on vertical support members 16 and allowing movement of the vertical support members along the elongated flat feet. As shown in FIG. 8, each of second mechanical fasteners 44 comprises an assembly including a slide 46 attached to a side edge of the flat foot 20. A spring loop 48 with end tabs 50 is tightened about vertical support member 16 with a bolt 51 that passes through apertures 52 in tabs 50 and through an elongated longitudinal slot 54 in slide 46. As a nut 56 is tightened on bolt 51, spring loop 48 is tighten on vertical support member 16 fixing the angle that flat feet 20 make with respect for horizontal cross member 14 and the position of vertical support member 16 along elongated slot 54.

Figure 9A:
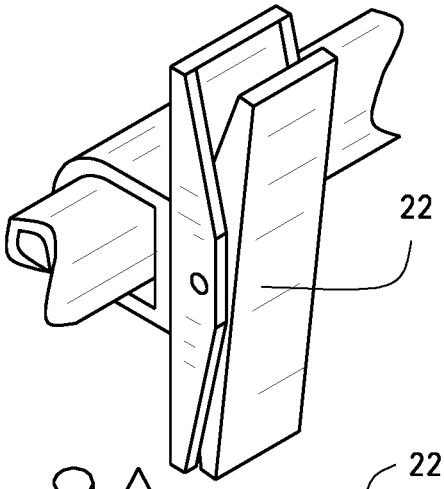
FIG. 9A is a perspective view of a swivel fastener in a first position.
Figure 9B:
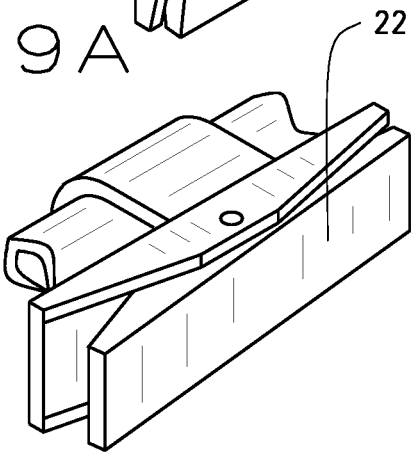
FIG. 9B is a perspective view of the swivel fastener in a second position; and, FIG. 10 is a plan view of the framework collapsed for transport.

Swivel fasteners 22 illustrated in the form of spring clamps are provided on horizontal cross member 14 and side arms 18. Swivel fasteners 22 in their basic form consist of two jaws held under tension by a metal spring. The jaws clamp down on both sides of piece of fabric 12 to keep it in place. The spring clamps as best seen in FIGS. 9A and 9B are preferably swivel mounted to the horizontal cross member and side arms to avoid loss and provide compaction on collapsed form as described below.

In the illustrated embodiment, horizontal cross member 14, vertical support members 16 and side arms 18 may have a circular cross-section and be constructed of a variety of materials, including, without limitation, aluminum, poly vinyl chloride (PVC), carbon reinforced plastics or the like. Elongated flat feet 20 may also be formed of similar materials. In most embodiments, it is advantageous for the material to be rigid enough to be self-supporting while light enough to allow framework 10 to be easily transported.

In the expanded configuration as shown in FIGS. 1-6, framework 10 forms a perimeter within which a mother may position her body while seated in a seat or chair with elongated flat feet 20 wedged under her legs such that vertical support members 16 are held upright. A curtain formed with piece of fabric 12 pinned with swivel fasteners 22 forms a concealed space for infant lactation or permits a mother to pump milk modestly. Framework 10 also provides an open space for maneuvering and helping the infant latch. The curtain formed by the fabric is spaced from the mother and infant such that air flow is not blocked and over heating and possible baby breathing difficulties are avoided. In addition the open space allows for eye contact between the mother and the infant which promotes bonding which is very important to both.

Figure 10:
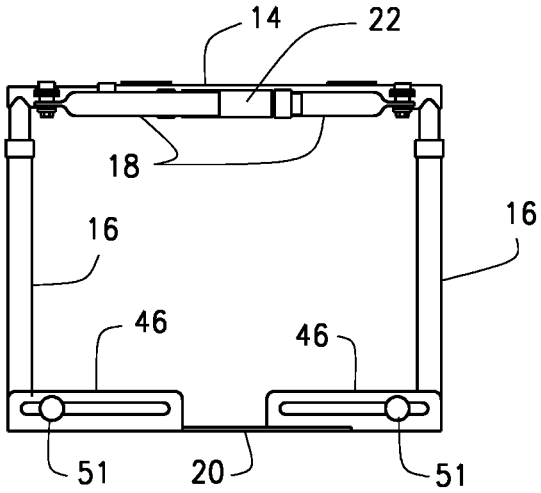

In collapsed form, piece of fabric 12 may be unpinned from swivel fasteners 22 which may be rotated such that they are aligned with horizontal cross member 14 and side arms 18. Horizontal cross member 14, vertical support members 16 and side arms 18 may be shortened by loosening snap or twist locks 24. By loosing nut 42 on bolt 36 of each first mechanical fastener 28 side arms 18 may be rotated inwardly such that they are parallel to horizontal cross member 14. By loosening nut 56 on bolt 51 of each second mechanical fastener 44 vertical members 16 may be slid along elongated slot 54 in slide 46 such that framework 10 folds into a flat rectangular form as shown in FIG. 10 for transport which may be in a diaper bag or the like.

In the preceding description, numerous specific details are set forth such as examples of specific components in order to provide a thorough understanding of embodiments of the present disclosure. It will be apparent to a person of ordinary skill in the art that these specific details should not be construed to limit the scope of the disclosure.

What is claimed is:

1. A framework for supporting a piece of fabric forming a concealed space for infant lactation within which a mother may position her body while seated in a seat or chair, said framework comprising a horizontal cross member formed of telescoping sections mounted on first and second vertical support members formed of telescoping sections, first and second side arms formed of telescoping sections mounted at opposite ends of the horizontal cross member with arm mechanical fasteners that allow angular movement of the first and second side arms in two planes with respect to the horizontal cross member, first and second elongated flat feet attached to the first and second vertical support members opposite the horizontal cross member with feet mechanical fasteners that allow rotation of the first and second feet on the first and second vertical support members and longitudinal movement along the first and second feet respectively, at least one pivotable fastener attached to each of said horizontal cross member and first and second side arms for attachment of the piece of fabric.

2. The framework of claim 1 wherein a snap or twist lock is provided on the horizontal cross member for controlling the extent to which the telescoping sections extend.

3. The frame work of claim 1 wherein a snap or twist lock is provided on each of the vertical support members and side arms for controlling the extent to which the telescoping sections extend.

4. A framework for supporting a piece of fabric forming a concealed space for infant lactation within which a mother may position her body while seated in a seat or chair, said framework comprising a horizontal cross member formed of telescoping sections mounted on first and second vertical support members formed of telescoping sections, first and second side arms formed of telescoping sections mounted at opposite ends of the horizontal cross member, each side arm mounted with a spring loop with tabs around the horizontal cross member and a tongue formed on an end of the side arm positioned between the tabs, a bolt passing through apertures in the tabs and the tongue and a nut when tightened on the bolt causes the spring loop to tighten on the horizontal cross member allowing a vertical angle of the side arm with respect to the horizontal cross member to be adjusted and set and as the nut is tightened on the bolt the tongue is pinched between the tabs allowing a horizontal angle of each side arm to the horizontal cross member to be adjusted and set, first and second elongated flat feet attached to the first and second vertical support members opposite the horizontal cross member with feet mechanical fasteners that allow rotation of the first and second feet on the first and second vertical support members and longitudinal movement along the first and second feet respectively, at least one pivotable fastener attached to each of said horizontal cross member and first and second side arms for attachment of the piece of fabric.

5. The framework of claim 4 wherein a long axis of each pivotable fastener aligns with a long axis of the horizontal cross member and first and second side arms to which the pivotable fastener is attached.

6. The framework of claim 4 wherein a snap or twist lock is provided on each of the horizontal cross member, vertical support members and side arms for controlling the extent to which the telescoping sections extend.

7. The framework of claim 4 wherein the elongated flat feet have a side slide with an elongated slot and a spring loop with tabs mounted around the vertical support members, a bolt passes through the elongated slot and through apertures in the tabs to tighten the tabs against the slide to set the angle elongated feet make with respect to the horizontal cross member and set longitudinal movement along the elongated flat feet.

8. The framework of claim 7 wherein the horizontal cross member, vertical support members and side arms have a circular cross section and are formed of plastic rigid enough to be self-supporting.

* * * * *